US008676075B2

(12) United States Patent
Matsushita et al.

(10) Patent No.: US 8,676,075 B2
(45) Date of Patent: Mar. 18, 2014

(54) IMAGE FORMING APPARATUS FOR SUPPRESSING REVERSE TRANSFER OF IMAGES

(75) Inventors: Yuichi Matsushita, Nagoya (JP); Masahiko Hayakawa, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 272 days.

(21) Appl. No.: 13/235,322

(22) Filed: Sep. 16, 2011

(65) Prior Publication Data

US 2012/0070171 A1 Mar. 22, 2012

(30) Foreign Application Priority Data

Sep. 16, 2010 (JP) ..... 2010-208004
Sep. 16, 2010 (JP) ..... 2010-208005

(51) Int. Cl.
*G03G 15/16* (2006.01)
*G03G 15/00* (2006.01)
*G03G 15/01* (2006.01)

(52) U.S. Cl.
USPC ..... 399/66; 399/82; 399/299

(58) Field of Classification Search
USPC ..... 399/299, 302, 314, 66, 82
See application file for complete search history.

(56) References Cited

U.S. PATENT DOCUMENTS 5,365,324 A * 11/1994 Gu et al. ..... 399/299
6,108,510 A 8/2000 Nakane
7,400,852 B2 * 7/2008 Furukawa ..... 399/302
7,561,840 B2 * 7/2009 Morimoto et al. ..... 399/299
7,813,683 B2 * 10/2010 Furuya et al. ..... 399/302
7,904,010 B2 * 3/2011 Meguro et al. ..... 399/299
8,023,872 B2 * 9/2011 Tao et al. ..... 399/302
8,121,526 B2 * 2/2012 Fukuyama et al. ..... 399/302
2006/0067734 A1 3/2006 Igarashi et al.
2008/0095556 A1 4/2008 Mochizuki

FOREIGN PATENT DOCUMENTS

JP H11-015291 A 1/1999
JP H11-065308 A 3/1999
JP H11-305561 A 11/1999
JP 2002-023452 A 1/2002
JP 2003-202729 A 7/2003
JP 2005-062642 A 3/2005
JP 2005-156776 A 6/2005
JP 2006-098539 A 4/2006
JP 2006-098772 A 4/2006

(Continued)

OTHER PUBLICATIONS

Japan Patent Office, Notification of Reason for Refusal for Japanese Patent Application No. 2010-208005, dispatched Jun. 26, 2012.

(Continued)

*Primary Examiner* — Susan Lee
(74) *Attorney, Agent, or Firm* — Baker Botts L.L.P.

(57) ABSTRACT

An image forming apparatus includes: a conveying belt; a first photosensitive member; and a second photosensitive member; a first transfer member; a second transfer member; a first pushing member; a second pushing member; and a changing unit, wherein the first photosensitive member is disposed on the upstream side of the second photosensitive member in a conveying direction of the transfer receiving member, and the changing unit changes the pushing force of the second transfer member that is disposed on the downstream side of the first photosensitive member in a conveying direction of the transfer receiving member.

12 Claims, 7 Drawing Sheets

(56) References Cited

FOREIGN PATENT DOCUMENTS

| | | | |
|---|---|---|---|
| JP | 2007-033938 | A | 2/2007 |
| JP | 2007-078754 | A | 3/2007 |
| JP | 2007-101948 | A | 4/2007 |
| JP | 2007-241163 | A | 9/2007 |
| JP | 2008-040397 | A | 2/2008 |
| JP | 2008-102164 | A | 5/2008 |
| JP | 2008-107506 | A | 5/2008 |
| JP | 2009-033938 | A | 2/2009 |
| JP | 2009-075350 | A | 4/2009 |
| JP | 2009-128580 | A | 6/2009 |

OTHER PUBLICATIONS

Japan Patent Office, Decision to Grant a Patent for Japanese Patent Application No. 2010-208004, dispatched Jun. 26, 2012.

* cited by examiner

IMAGE FORMING APPARATUS FOR SUPPRESSING REVERSE TRANSFER OF IMAGES

CROSS REFERENCE TO RELATED APPLICATION

The present application claims priority from Japanese Patent Application No. 2010-208004, which was filed on Sep. 16, 2010, and Japanese Patent Application No. 2010-208005, which was filed on Sep. 16, 2010, the disclosures of which are herein incorporated by reference in its entirety.

TECHNICAL FIELD

The present invention relates to an image forming apparatus such as a laser printer.

BACKGROUND

A tandem-type color laser printer, which includes a plurality of photosensitive bodies and a conveying belt facing the respective photosensitive bodies, is known as an electrophotographic color printer. The plurality of photosensitive bodies is disposed in parallel so as to correspond to color toner, that is, yellow toner, magenta toner, cyan toner, and black toner.

For example, there is proposed a laser printer. The laser printer includes four (yellow, magenta, cyan, and black) photoreceptor drums that are disposed in parallel in a longitudinal direction, a transfer belt that comes into contact with the respective photoreceptor drums and conveys a sheet from the front side to the rear side, and transfer rollers that face the respective photoreceptor drums with the transfer belt interposed between the transfer rollers and the photoreceptor drums (for example, see Patent Document 1).

RELATED ART DOCUMENT

Patent Document

[Patent Document 1] JP-A-2006-98772

SUMMARY

Meanwhile, in the above-mentioned Patent Document 1, only black toner is used when a monochrome image is to be formed. Accordingly, the respective color (yellow, magenta, and cyan) photoreceptor drums come into contact with the transfer belt while toner images are not carried on the respective color photoreceptor drums.

For this reason, after a toner image carried on a black photoreceptor drum is transferred to a sheet once, the toner image is reversely transferred to the color photoreceptor drums from the sheet when facing the color photoreceptor drums disposed on the rear side of the black photoreceptor drum (on the downstream side in a conveying direction of a sheet).

In this case, after the photoreceptor drum makes one rotation, the reversely transferred toner image is transferred to the sheet at the position deviated from the original image again (reverse transfer ghost).

Accordingly, an object of the invention is to provide a direct tandem-type image forming apparatus that can suppress the generation of a reverse transfer ghost in a monochrome mode.

In order to achieve the above-mentioned object, according to a first aspect of the invention, there is provided an image forming apparatus of which the mode is switched to a monochrome mode where a monochrome image is formed and a color mode where a color image is formed, the image forming apparatus comprising: a conveying belt that conveys a transfer receiving member; a first photosensitive member that carries a black developer image to be the transfer receiving member; a second photosensitive member that carries a developer image except for the black developer image to be the transfer receiving member, the second photosensitive member disposed on the downstream side of the first photosensitive member in a conveying direction of the transfer receiving member, a first transfer member that faces the first photosensitive member with the conveying belt interposed therebetween; a second transfer member that faces the second photosensitive member with the conveying belt interposed therebetween; a first pushing member that is configured to push the first transfer member toward the first photosensitive member; a second pushing member that is configured to push the second transfer member toward the second photosensitive member; and a changing unit that changes the pushing force of the second pushing member to a first pushing force set in the color mode and a second pushing force set to be smaller than the first pushing force in the monochrome mode.

According to the aspect of the invention, in the monochrome mode, it may be possible to change the pushing force of the second transfer member corresponding to at least the second photosensitive member, which is disposed adjacent to the first photosensitive member on the downstream side of the first photosensitive member in the conveying direction, to the second pushing force, which is smaller than the first pushing force set in the color mode.

For this reason, in the monochrome mode, it may be possible to reduce the pressing force of the second transfer member, which corresponds to the second photosensitive member disposed adjacent to the first photosensitive member on the downstream side of the first photosensitive member in the conveying direction, to the second photosensitive member.

Accordingly, it may be possible to suppress the reverse transfer of the developer image, which has been transferred to the transfer receiving member from the first photosensitive member, to the second photosensitive member.

As a result, it may be possible to suppress the generation of a reverse transfer ghost in the monochrome mode in the direct tandem-type image forming apparatus.

In order to achieve the above-mentioned object, according to a second aspect of the invention, there is provided an image forming apparatus of which the mode is switched to a monochrome mode where a monochrome image is formed and a color mode where a color image is formed, the image forming apparatus comprising: a conveying belt that conveys a transfer receiving member; a first photosensitive member that carries a black developer image to be the transfer receiving member; a second photosensitive member that carries a developer image except for the black developer image to be the transfer receiving member, the second photosensitive member disposed on the downstream side of the first photosensitive member in a conveying direction of the transfer receiving member; a first transfer member that faces the first photosensitive member with the conveying belt interposed therebetween; a second transfer member that faces the second photosensitive member with the conveying belt interposed therebetween; a moving member that moves the second transfer member between a contact position where the second transfer member contacts with the conveying belt in the color mode and a separate position where the second transfer member is separated from the conveying belt in the monochrome mode; and a bias applying unit that applies bias to the first transfer member and the second transfer member in both the monochrome mode and the color mode.

Further, according to a third aspect of the invention, there is provided an image forming apparatus of which the mode is switched to a monochrome mode where a monochrome image is formed and a color mode where a color image is formed, the image forming apparatus comprising: a conveying belt that conveys a transfer receiving member; a first photosensitive member that carries a black developer image to be the transfer receiving member; a second photosensitive member that carries a developer image except for the black developer image to be the transfer receiving member, the second photosensitive member disposed on the downstream side of the first photosensitive member in a conveying direction of the transfer receiving member, a first transfer member that faces the first photosensitive member with the conveying belt interposed therebetween; a second transfer member that faces the second photosensitive member with the conveying belt interposed therebetween; a charge removing member that is disposed adjacent to the second transfer member on the downstream side of the second transfer member in a conveying direction of the transfer receiving member, and faces the conveying belt; a moving member that moves the second transfer member between a contact position where the second transfer member contacts with the conveying belt in the color mode and a separate position where the second transfer member is separated from the conveying belt in the monochrome mode; and a first bias applying unit that applies a transfer bias to the first transfer member and the second transfer member when the second transfer member is located on the contact position in the color mode, wherein the first bias applying unit applies the transfer bias to the first transfer member and does not apply the transfer bias to the second transfer member when the second transfer member is located on the separate position in the monochrome mode; and a second bias applying unit that applies a transfer bias to the charge removing member when the second transfer member is located on the separate position in the monochrome mode.

According to the second aspect of the invention, the second transfer members, which correspond to at least the second photosensitive members disposed adjacent to the first photosensitive member on the downstream side of the first photosensitive member in the conveying direction, are separated from the conveying belt in the monochrome mode while transfer bias is applied to the second transfer members.

For this reason, it may be possible to reduce a pressing force of the transfer receiving member that is applied to the second photosensitive members, and to continue to carry the developer image, which has been transferred to the transfer receiving member, on the transfer receiving member by the transfer bias applied to the second transfer members.

Accordingly, it may be possible to suppress the reverse transfer of the developer image, which has been transferred to the transfer receiving member, to the second photosensitive members.

As a result, in the direct tandem-type image forming apparatus, it may be possible to suppress the generation of a reverse transfer ghost in the monochrome mode.

According to the third aspect of the invention, the second transfer members, which correspond to at least the second photosensitive members disposed adjacent to the first photosensitive member on the downstream side of the first photosensitive member in the conveying direction, are separated from the conveying belt in the monochrome mode while transfer bias is not applied to the second transfer members. Further, transfer bias is applied to the charge removing members that are disposed adjacent to the second transfer members.

For this reason, it may be possible to reduce a pressing force of the transfer receiving member that is applied to the second photosensitive members, and to continue to carry the developer image, which has been transferred to the transfer receiving member, on the transfer receiving member by the transfer bias applied to the charge removing members.

Accordingly, it may be possible to suppress the reverse transfer of the developer image, which has been transferred to the transfer receiving member, to the second photosensitive members.

As a result, in the direct tandem-type image forming apparatus, it may be possible to suppress the generation of a reverse transfer ghost in the monochrome mode.

BRIEF DESCRIPTION OF THE DRAWINGS

Illustrative aspects of the invention will be described in detail with reference to the following figures wherein:

FIG. 2A and FIG. 2B are side views illustrating the operation of a transfer unit of a first embodiment, wherein FIG. 2A illustrates the operation of the transfer unit in a color mode and FIG. 2B illustrates the operation of the transfer unit in a monochrome mode;

FIG. 3A and FIG. 3B are side views illustrating the operation of a transfer unit of a second embodiment, wherein FIG. 3A illustrates the operation of the transfer unit in a color mode and FIG. 3B illustrates the operation of the transfer unit in a monochrome mode;

FIG. 4A illustrates the operation of the transfer unit in a color mode and FIG. 4B illustrates the operation of the transfer unit in a monochrome mode;

FIG. 6A and FIG. 6B are side views illustrating the operation of a transfer unit of a fourth embodiment, wherein FIG. 6A illustrates the operation of the transfer unit in a color mode and FIG. 6B illustrates the operation of the transfer unit in a monochrome mode; and FIG. 7A and FIG. 7B are side views illustrating the operation of a transfer unit of a fifth embodiment, wherein FIG. 7A illustrates the operation of the transfer unit in a color mode and FIG. 7B illustrates the operation of the transfer unit in a monochrome mode.

DETAILED DESCRIPTION OF EXEMPLARY EMBODIMENTS OF THE PRESENT INVENTION

[First Embodiment]

1. Entire Structure of Color Laser Printer

Figure 1:
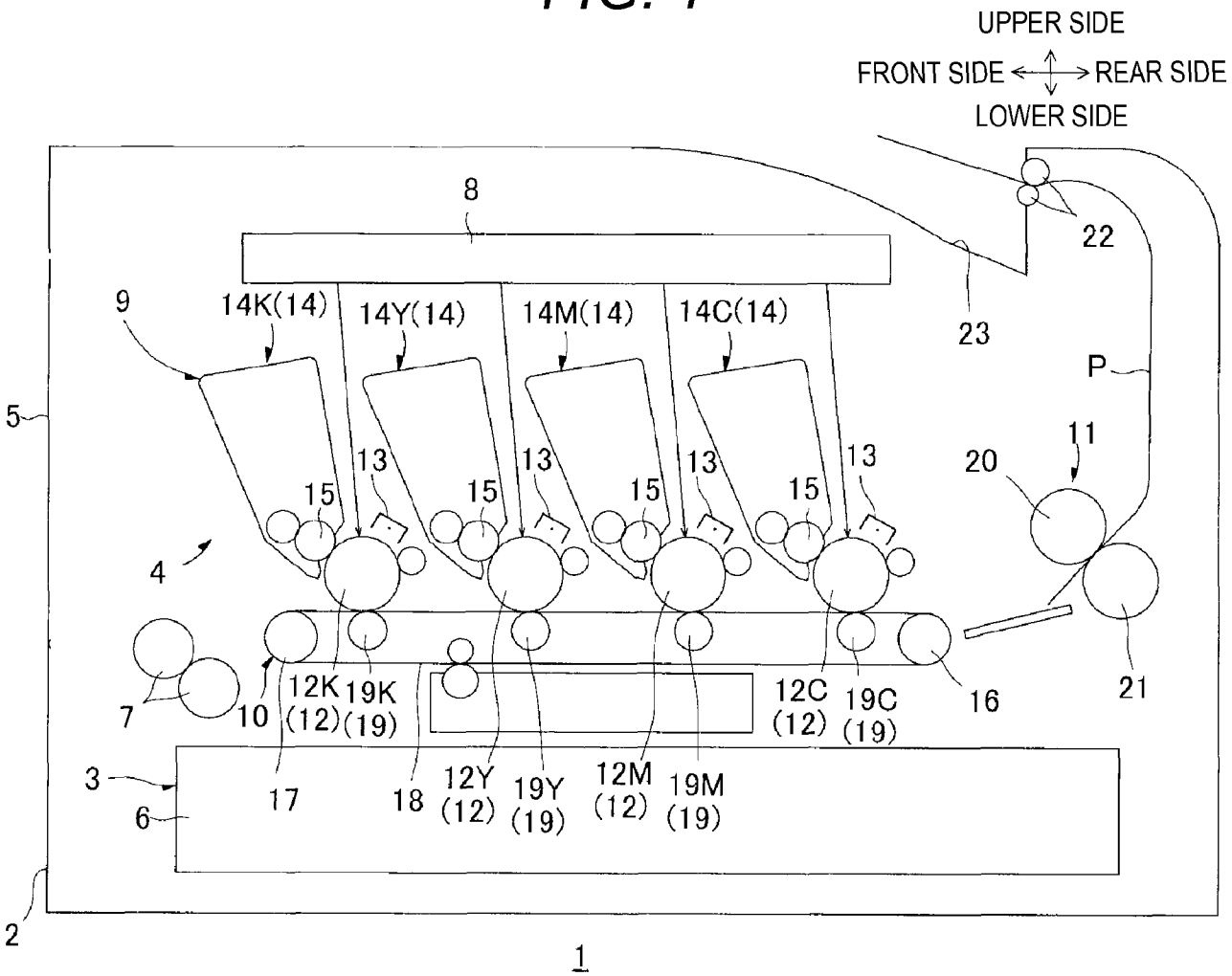
FIG. 1 is a side cross-sectional view of a color laser printer as an example of an image forming apparatus according to the invention.

As shown in FIG. 1, a color laser printer 1 as an example of an image forming apparatus is a horizontally-mounted direct tandem-type color laser printer. The color laser printer 1 includes a sheet feed section 3 and an image forming section 4 that are disposed in a main body casing 2. The sheet feed section 3 feeds a sheet P as an example of a transfer receiving member. The image forming section 4 forms an image on the fed sheet P.

(1) Main Body Casing

The main body casing 2 is formed in the shape of a substantially rectangular box in side view so as to accommodate the sheet feed section 3 and the image forming section 4. A front cover 5, which is used for the attachment or detachment of a process unit 9 to be described below, is formed at one side wall of the main body casing 2. The front cover 5 is provided so as to be pivotable about a lower end portion of the front cover relative to the main body casing 2.

Meanwhile, in the following description, the side (the left side in FIG. 1) where the front cover 5 is provided is referred to as the front side and the side opposite (the right side in FIG. 1) is referred to as the rear side. Further, when the color laser printer 1 is seen from the front side, the left and right sides of the color laser printer become references. That is, the front side in FIG. 1 is the right side and the back side in FIG. 1 is the left side.

(2) Sheet Feed Section

The sheet feed section 3 includes a sheet feed tray 6 that stores sheets P. The sheet feed tray 6 is detachably mounted on a bottom in the main body casing 2.

The sheets P stored in the sheet feed tray 6 are fed toward a gap between a pair of resist rollers 7, which is disposed above a front end portion of the sheet feed tray 6, one by one, and are conveyed toward the image forming section 4 (a gap between a photosensitive drum 12 (to be described below) and a conveying belt 18 (to be described below)) at a predetermined timing.

(3) Image Forming Section

The image forming section 4 includes a scanner unit 8, process units 9, a transfer unit 10, and a fixing unit 11.

(3-1) Scanner Unit

The scanner unit 8 is disposed at an upper portion of the main body casing 2. The scanner unit 8 emits laser beams to four photosensitive drums 12 (to be described below) on the basis of image data as shown by a solid line, and exposes the photosensitive drums 12 (to be described below).

(3-2) Process Unit (3-2-1) Structure of Process Unit

Each of the process units 9 is disposed below the scanner unit 8 and on the transfer unit 10, and includes a photosensitive drum 12 as an example of a photosensitive body, a scorotron-type charger 13, and a developing unit 14.

The photosensitive drum 12 is formed substantially in the shape of a cylinder extending in a horizontal direction. Four photosensitive drums are horizontally disposed in parallel at intervals in a longitudinal direction. Specifically, a black photosensitive drum 12K as an example of a first photosensitive body, and a yellow photosensitive drum 12Y, a magenta photosensitive drum 12M, and a cyan photosensitive drum 12C as examples of three second photosensitive bodies are sequentially disposed from the front side toward the rear side.

The scorotron-type charger 13 is disposed on the upper rear side of each photosensitive drum 12 with an interval between the scorotron-type charger and each photosensitive drum so as to face each photosensitive drum 12.

The developing units 14 are disposed above the photosensitive drums 12 so as to correspond to the respective photosensitive drums 12. Specifically, a black developing unit 14K, a yellow developing unit 14Y, a magenta developing unit 14M, and a cyan developing unit 14C are sequentially disposed from the front side toward the rear side.

Further, each of the developing units 14 includes a developing roller 15.

The developing roller 15 is rotatably supported at a lower end of the developing unit 14 so as to be exposed from the rear side, faces the photosensitive drum 12 from the upper front side, and comes onto contact with the photosensitive drum 12.

Toner as an example of a developer corresponding to each of the colors is stored in a space above the developing roller 15 in each developing unit 14.

(3-2-2) Developing Operation in Process Unit

As the developing roller 15 is rotated, the toner stored in the developing unit 14 is carried onto the surface of the developing roller 15.

Meanwhile, as the photosensitive drum 12 is rotated, the surface of the photosensitive drum 12 is uniformly charged by the scorotron-type charger 13 and then exposed by the high-speed scanning of the laser beam (see broken lines in FIG. 1) emitted from the scanner unit 8. Accordingly, an electrostatic latent image, which corresponds to an image to be formed on a sheet P, is formed on the surface of the photosensitive drum 12.

When the photosensitive drum 12 is further rotated, the toner carried onto the surface of the developing roller 15 is supplied to the electrostatic latent image that is formed on the surface of the photosensitive drum 12. Accordingly, the electrostatic latent image formed on the photosensitive drum 12 is changed into a visible image, and a toner image formed by reversal development is carried on the surface of the photosensitive drum 12.

(3-3) Transfer Unit

The transfer unit 10 is disposed along the longitudinal direction above the sheet feed section 3 and below the process unit 9 in the main body casing 2. The transfer unit 10 includes a driving roller 16, a driven roller 17, a conveying belt 18, and four transfer rollers 19.

The driving roller 16 and the driven roller 17 are disposed so as to face each other with an interval therebetween in the longitudinal direction.

The conveying belt 18 faces the respective photosensitive drums 12 from below, and is wound around the driving roller 16 and the driven roller 17 so that the upper portion of the conveying belt comes into contact with the respective photosensitive drums 12. Further, the conveying belt 18 is rolled along by the driving of the driving roller 16 so that the upper portion of the conveying belt 18 coming into contact with the respective photosensitive drums 12 is moved from the front side toward the rear side.

The respective transfer rollers 19 are provided so as to face the respective photosensitive drums 12 while the upper portion of the conveying belt 18 is interposed between the transfer rollers and the photosensitive drums. Specifically, a black transfer roller 19K as an example of a first transfer member facing the black photosensitive drum 12K; and a yellow transfer roller 19Y, a magenta transfer roller 19M, and a cyan transfer roller 19C as examples of three second transfer members, which face the yellow photosensitive drum 12Y, the magenta photosensitive drum 12M, and the cyan photosensitive drum 12C, respectively, are sequentially disposed from the front side toward the rear side.

Further, a sheet P fed from the sheet feed section 3 is conveyed from the front side toward the rear side by the conveying belt 18 so as to sequentially pass through transfer positions where the respective photosensitive drums 12 face the respective transfer rollers 19. While the sheet is conveyed, the respective color toner images carried on the respective photosensitive drums 12 are sequentially transferred to the sheet P, so that a color image is formed.

(3-4) Fixing Unit

The fixing unit 11 is disposed on the rear side of the transfer unit 10, and includes a heating roller 20 and a pressure roller 21 facing the heating roller 20. In the transfer unit 10, a color image transferred to the sheet P is thermally fixed to the sheet P by being heated and pressed while the sheet P passes between the heating roller 20 and the pressure roller 21.

(4) Sheet Discharge

The sheet P to which the toner images have been fixed is conveyed by sheet discharge rollers 22 so as to pass through a U-turn path (not shown), and is discharged onto a sheet discharge tray 23 that is formed above the scanner unit 8.

2. Detail of Transfer Unit (1) Structure of Transfer Unit

As described above and shown in FIG. 2, the transfer unit 10 of the first embodiment includes the conveying belt 18 that comes into contact with the respective photosensitive drums 12 from below and the respective transfer rollers 19 that face the respective photosensitive drums 12 with the conveying belt 18 interposed therebetween.

The conveying belt 18 is made of an elastic material or the like having conductivity and is formed in an endless shape.

Each of the transfer rollers 19 includes a transfer roller shaft 34 and a roller portion 35.

The transfer roller shaft 34 is made of a conductive material such as metal and is formed in the shape of a rod extending in the horizontal direction.

The roller portion 35 is made of an elastic material or the like having conductivity and is formed in a substantially cylindrical shape so as to cover the surface of the transfer roller shaft 34.

Further, the transfer unit 10 includes compression springs 31 and a translation cam mechanism 30 as an example of changing unit.

The compression spring 31 is provided between the transfer roller shaft 34 of each of the transfer rollers 19 and each of corresponding support members 32 (to be described below). In detail, there are provided black-side compression springs 31A as an example of first pushing members that are provided so as to correspond to the black transfer roller 19K and color-side compression springs 31B as an example of second pushing members that are provided so as to correspond to the respective color transfer rollers 19.

One ends of the respective compression springs 31 are connected to both end portions of the corresponding transfer roller shaft 34 in a horizontal direction, and the other ends thereof are connected to the upper ends of the corresponding support members 32 (to be described below). Further, the spring constants of the respective compression springs 31 are set to be equal to each other.

Accordingly, the respective compression springs 31 elastically press the corresponding transfer rollers 19 toward the corresponding photosensitive drums 12.

The translation cam mechanism 30 includes support members 32 and a translation cam 33.

The support member 32 is formed to have a substantially U shape, of which the lower side is opened, in side view. Two support members are disposed at intervals below both the left and right ends of the transfer roller shaft 34, respectively, so as to correspond to each of the transfer rollers 19. In detail, there are provided black-side support members 32A that are provided so as to correspond to the black transfer roller 19K and color-side support members 32B that are provided so as to correspond to the color transfer rollers 19 (the yellow transfer roller 19Y, the magenta transfer roller 19M, and the cyan transfer roller 19C), respectively. Further, a support member-side inclined surface 36, which is inclined upward toward the front side, is formed at the rear upper end portion of each of the support members 32.

Furthermore, each of the color-side support members 32B is supported by a frame (not shown) of the transfer unit 10 so as to be slidable to a close position (see FIG. 2A) close to the transfer roller shaft 34 and a separate position (see FIG. 2B) separated from the transfer roller shaft 34 in a vertical direction. Moreover, each of the color-side support members 32B is always pushed by pushing means (not shown) so as to be disposed at the close position.

Meanwhile, the black-side support members 32A are positioned and fixed to the frame (not shown) of the transfer unit 10.

The translation cam 33 is disposed between the respective color transfer rollers 19 and the respective color-side support members 32B and is formed substantially in the shape of a bar extending in the longitudinal direction. Moreover, the translation cam 33 includes three displacement portions 37.

The displacement portions 37 are disposed in parallel at intervals in the longitudinal direction so as to correspond to the color-side support members 32B, respectively. Further, each of the displacement portions 37 protrudes downward from the lower surface of the translation cam 33 and is formed to have a substantially trapezoidal shape in side view. Furthermore, a cam-side inclined surface 38, which is inclined upward toward the front side, is formed at the front end portion of each of the displacement portions 37. The lower surface of each of the displacement portions 37 is formed of a flat surface 39 that continues from the rear end portion of the cam-side inclined surface 38 and extends toward the rear side.

Figure 2A:
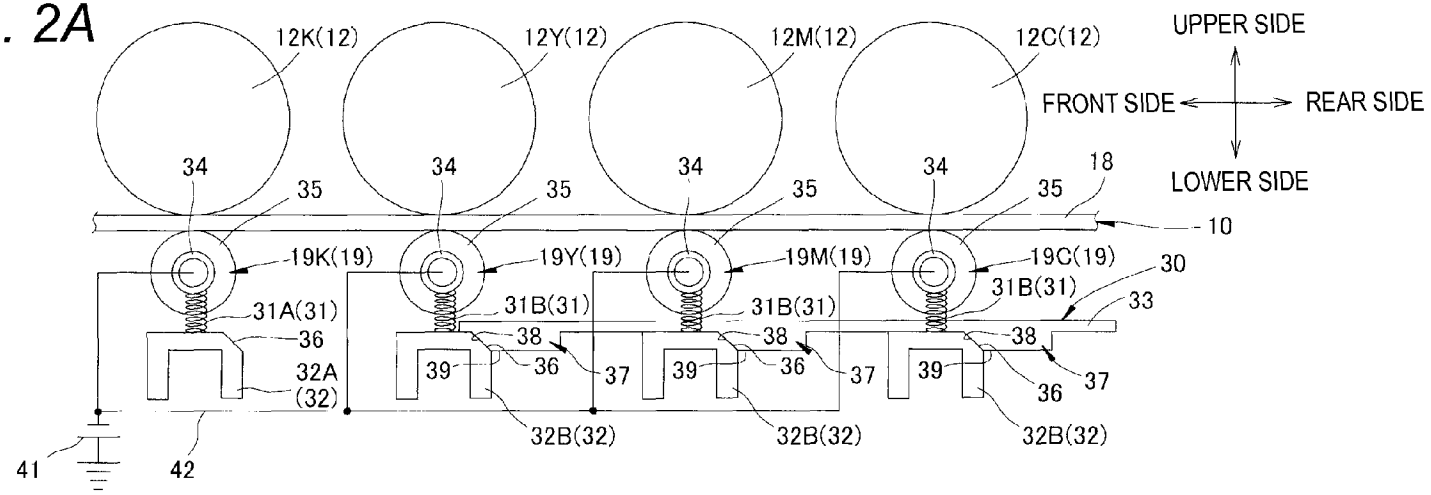

Further, the translation cam 33 is supported by the frame (not shown) of the transfer unit 10 so as to be slidable in the longitudinal direction and make the respective displacement portions 37 be disposed on the rear side of the corresponding color-side support members 32B (see FIG. 2A).

In this case, the cam-side inclined surfaces 38 of the respective displacement portions 37 face the support member-side inclined surfaces 36 of the corresponding color-side support members 32B from the rear side.

(2) Operation for Changing Pushing Force of Compression Spring

When the respective displacement portions 37 of the translation cam 33 are disposed on the rear side of the corresponding color-side support members 32B, the translation cam 33 does not press the color-side support members 32B as shown in FIG. 2A and the color-side support members 32B are disposed at the close positions by the pushing forces of the pushing means (not shown).

In this case, the color-side compression springs 31B are compressed by the corresponding color-side support members 32B and are thus in a first compressed state. Accordingly, the color-side compression springs 31B push the corresponding transfer rollers 19 toward the photosensitive drums 12 by first pushing forces.

Further, when the translation cam 33 is slid forward by driving means (not shown) provided in the main body casing 2, the cam-side inclined surfaces 38 of the respective displacement portions 37 come into contact with the support member-side inclined surfaces 36 of the corresponding color-side support members 32B.

Furthermore, when the translation cam 33 is further moved forward, the support member-side inclined surfaces 36 of the respective color-side support members 32B are pressed down by the cam-side inclined surfaces 38 of the corresponding displacement portions 37 so as to be slid toward the lower rear side relative to the cam-side inclined surfaces 38 of the corresponding displacement portions 37. Accordingly, each of the color-side support members 32B is moved downward from the close position toward the separate position.

Figure 2B:
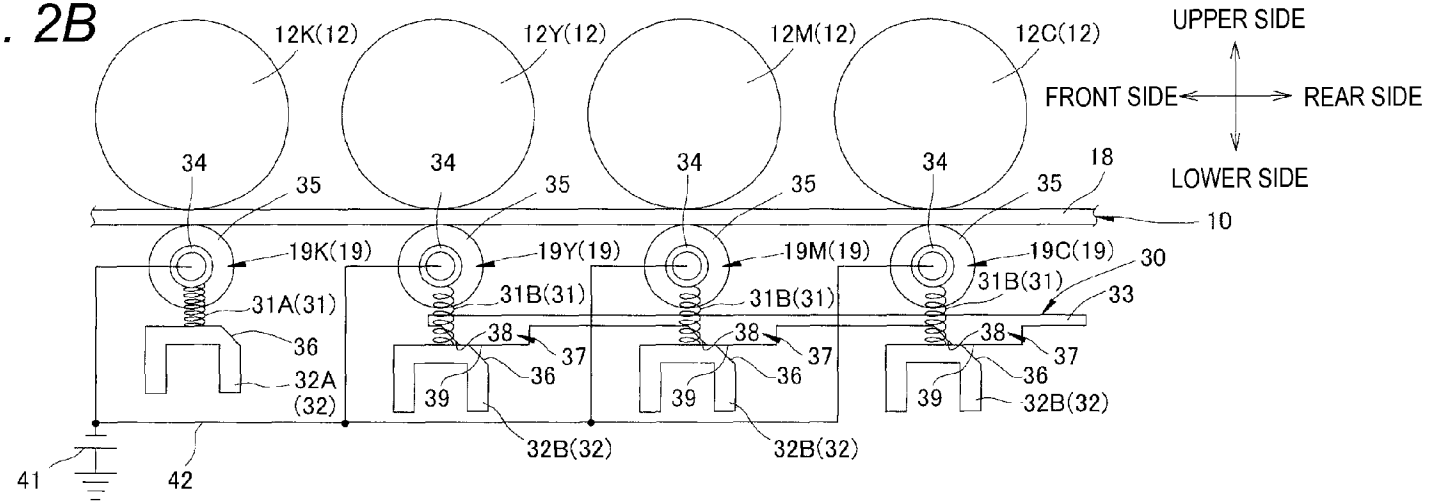

As a result, the color-side compression springs 31B are in a second compressed state, which is further restored from the first compressed state, as shown in FIG. 2B and push the corresponding transfer rollers 19 toward the photosensitive drums 12 by second pushing forces smaller than the first pushing forces. Meanwhile, the second pushing forces of all color-side compression springs 31B are set to be equal to each other.

(3) Supply of Power to Transfer Roller

The transfer roller shafts 34 of the respective transfer rollers 19 are electrically connected to a power source 41, which is provided in the main body casing 2, through transfer bias lines 42.

Further, even though the color laser printer 1 is in any one of the color mode (see FIG. 2A) and the monochrome mode (see FIG. 2B), transfer bias is applied to the respective transfer rollers 19 from the power source through the respective transfer bias lines 42.

3. Image Forming Operation (1) Image Forming Operation in Color Mode

When the color laser printer 1 is in the color mode, the translation cam 33 is drawn back as described above and shown in FIG. 2A.

In this case, each of the color-side support members 32B is disposed at the close position.

Then, as described above, a sheet P is conveyed from the front side toward the rear side by the conveying belt 18 so as to sequentially pass through the transfer positions where the respective photosensitive drums 12 face the respective transfer rollers 19. While the sheet is conveyed, the respective color toner images carried on the respective photosensitive drums 12 are sequentially transferred to the sheet P by transfer bias, so that a color image is formed.

(2) Image Forming Operation in Monochrome Mode

When the mode of the color laser printer 1 is switched to the monochrome mode from the color mode, the translation cam 33 is slid forward by the driving means (not shown) provided in the main body casing 2.

As a result, each of the color-side support members 32B is pressed down by the translation cam 33 as described above and is moved from the close position toward the separate position.

Accordingly, the color-side compression springs 31B push the corresponding transfer rollers 19 toward the photosensitive drums 12 by the second pushing forces smaller than the first pushing forces.

That is, when the mode of the color laser printer 1 is switched to the monochrome mode, the pressing forces of the color transfer rollers 19 to the photosensitive drums 12 are reduced.

Then, as described above, a sheet P is conveyed from the front side toward the rear side by the conveying belt 18 so as to sequentially pass through the transfer positions where the respective photosensitive drums 12 face the respective transfer rollers 19.

Accordingly, when the sheet P faces the black photosensitive drum 12K, a black toner image carried on the black photosensitive drum 12K is transferred to the sheet P.

After that, the sheet P sequentially passes between the respective corresponding transfer rollers 19 and the respective color photosensitive drums 12 on which toner images are not carried.

In this case, the pressing forces of the respective color transfer rollers 19 to the photosensitive drums 12 are reduced as described above. Further, transfer bias is applied to the respective color transfer rollers 19.

For this reason, a black toner image transferred to the sheet P is not easily attached to the surface of the photosensitive drum 12 by the reduced pressing forces of the transfer rollers 19 to the photosensitive drums 12, and is carried on the surface of the sheet P by the transfer bias.

That is, the reverse transfer of the black toner image, which has been transferred to the sheet P, to the respective color photosensitive drums 12 is suppressed.

Accordingly, in the monochrome mode, a monochrome image is formed on the sheet P without the generation of a reverse transfer ghost.

Meanwhile, when the mode of the color laser printer is switched to the color mode, the translation cam 33 is slid rearward again by the driving means (not shown) provided in the main body casing 2.

4. Operational Advantages (1) According to the color laser printer 1, as shown in FIG. 2, it may be possible to change the pushing forces of the color-side compression springs 31B to the second pushing forces smaller than the first pushing forces, which are set in the color mode, in the monochrome mode.

For this reason, in the monochrome mode, it may be possible to reduce the pressing forces of the respective color transfer rollers 19 (the yellow transfer roller 19Y, the magenta transfer roller 19M, and the cyan transfer roller 19C) to the photosensitive drums 12.

Accordingly, it may be possible to suppress the transfer of the toner image, which is transferred to the sheet P from the black photosensitive drum 12K, to the respective color photosensitive drums 12.

As a result, in the direct tandem-type color laser printer 1, it may be possible to suppress the generation of a reverse transfer ghost in the monochrome mode.

(2) Further, according to the color laser printer 1, the black photosensitive drum 12K is disposed on the front side of all the color photosensitive drums 12 as shown in FIG. 2.

For this reason, in the color mode, it may be possible to form various colors by sequentially superimposing color toner images on the black toner image (for example, it may be possible to form brown by superimposing yellow on a black base).

As a result, it may be possible to form various colors in the color mode.

(3) Further, according to color laser printer 1, the support members 32 and the translation cam 33 change the pushing forces of all the color transfer rollers 19 as shown in FIG. 2.

For this reason, it may be possible to uniformly reduce the pressing forces of all the color transfer rollers 19 to the photosensitive drums 12.

As a result, it may be possible to more reliably suppress the generation of a reverse transfer ghost in the monochrome mode.

(4) Furthermore, according to the color laser printer 1, all the pushing forces of the color-side compression springs 31B are set to be equal to each other in the monochrome mode.

For this reason, it may be possible to change the pushing forces of the color-side compression springs 31B to the same pushing force at one time by moving the translation cam 33 without providing changing unit for each of the color-side compression springs 31B.

As a result, it may be possible to uniformly change the pushing forces of the color-side compression springs 31B by the structure simpler than the structure where the changing unit is provided for each of the color-side compression springs 31B.

(5) Further, according to the color laser printer 1, as shown in FIG. 2, transfer bias is applied to all the transfer rollers 19 in the monochrome mode and the color mode.

For this reason, when a sheet P faces the respective color photosensitive drums 12 in not only the color mode but also the monochrome mode, it may be possible to make a toner image be carried on the sheet P by the transfer bias of each of the transfer rollers 19.

As a result, it may be possible to further suppress the transfer of the toner image, which has been transferred to the sheet P, to the color photosensitive drums 12.

5. [Second Embodiment]

The compressed state of each of the compression springs 31 is changed by the translation cam mechanism 30 in the above-mentioned first embodiment, so that the pushing force of each of the compression springs 31 applied to the transfer roller 19 is changed.

Meanwhile, as shown in FIGS. 3 and 4, eccentric cam mechanisms 50 and pushing units 53 each of which includes a pair of compression springs 51 are provided in a second embodiment. The compression springs 51 of the pushing units 53 are made to come into contact with or be separated from transfer roller shafts 34 by the eccentric cam mechanisms 50, so that the pushing forces applied to the transfer rollers 19 are changed. Meanwhile, in the second embodiment, the same members as those of the first embodiment are denoted by the same reference numerals and the description thereof will be omitted.

(1) Structure of Transfer Unit

A transfer unit 10 of the second embodiment includes the pushing units 53, and the eccentric cam mechanisms 50 as an example of changing unit.

The pushing unit 53 is disposed below each of both the left and right ends of the transfer roller shaft 34, respectively, so as to correspond to each transfer roller 19. In detail, there are provided black-side pushing units 53A as an example of first pushing members that are provided so as to correspond to a black transfer roller 19K and color-side pushing units 53B as an example of second pushing members that are provided so as to correspond to color transfer rollers 19.

Each of the pushing units 53 includes a support member 55 and a pair of compression springs 51.

The support member 55 is formed to have a substantially U shape, of which the lower side is opened, in side view. The support members are disposed at intervals below the transfer roller shaft 34.

Both the compression springs 51 are disposed adjacent to each other in a horizontal direction. That is, two compression springs 51 are disposed at each of both end portions of the transfer roller shaft 34 in the horizontal direction (see FIG. 4).

One end of the compression spring 51, which is provided at the inner position in the horizontal direction, is connected to the end portion of the transfer roller shaft 34 in the horizontal direction, and the other end thereof is connected to the upper end of the support member 55.

Further, one end of the compression spring 51 of the color-side pushing unit 53B, which is provided at the outer position in the horizontal direction, is connected to the lower surface of a pressing member 54 (to be described below), and the other end thereof is connected to the upper end of the support member 55. Meanwhile, one end of the compression spring 51 of the black-side pushing unit 53A, which is provided at the outer position in the horizontal direction, is connected to the end portion of the transfer roller shaft 34 of the black transfer roller 19K in the horizontal direction, and the other end thereof is connected to the upper end of the corresponding support member 55.

All the spring constants of the respective compression springs 51 of the respective pushing units 53, which are provided at the inner positions in the horizontal direction, are set to be equal to each other, and all the spring constants of the respective compression springs 51 of the respective pushing units, which are provided at the outer positions in the horizontal direction, are also set to be equal to each other. That is, all the pushing forces of the respective pushing units 53 are set to be equal to each other.

The eccentric cam mechanism 50 is provided at each of the left and right ends of each color transfer roller 19, and includes a pressing member 54 and an eccentric cam 52.

The pressing member 54 is disposed between the support member 55 and the transfer roller shaft 34 and on the compression spring 51 that is provided at the outer position in the horizontal direction. The pressing member is formed substantially in the shape of a bar extending in the longitudinal direction. The pressing member 54 is rotatably supported at the front end portion thereof by a frame (not shown) of the transfer unit 10. Further, the pressing members 54 is always pushed counterclockwise in right side view by the pushing force of the compression spring 51 that is provided at the outer position in the horizontal direction, and comes into contact with the transfer roller shaft 34 from below.

The eccentric cam 52 is disposed above the rear end portion of the pressing member 54, and is formed to have a substantially oval shape in side view. The eccentric cam 52 is always disposed so as to extend in the longitudinal direction (see FIG. 3A), and is rotatably supported at the front end portion thereof by the frame (not shown) of the transfer unit 10.

Figure 3A:
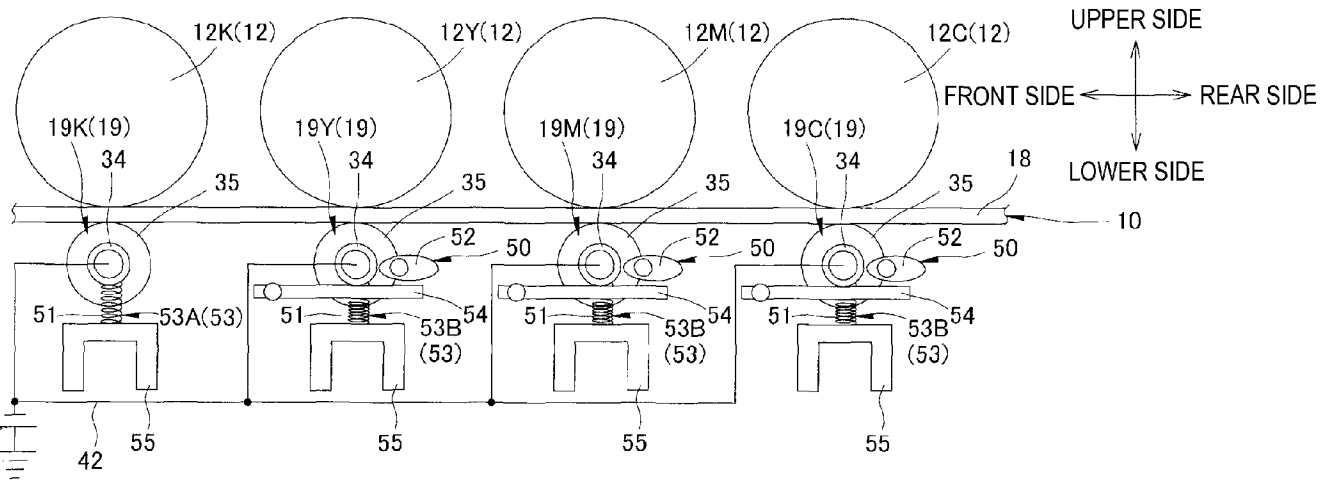

Moreover, when being disposed along the longitudinal direction, the eccentric cam 52 is separated from the rear end portion of the pressing member 54 with an interval therebetween in the vertical direction (see FIG. 3A). When being rotated so as to be suspended in the vertical direction, the eccentric cam 52 is disposed so as to come into contact with the rear end portion of the pressing member 54 (see FIG. 3B).

(2) Operation for Changing Pushing Force of Pushing Unit

When being disposed along the longitudinal direction as described above and shown in FIGS. 3A and 4A, the eccentric cam 52 is separated from the upper portion of the rear end portion of the pressing member 54. Further, the pressing member 54 is made to come into contact with the transfer roller shaft 34 from below by the pushing force of the compression spring 51 that is provided at the outer position in the horizontal direction.

In this case, the color-side pushing unit 53B pushes the transfer roller 19 toward the photosensitive drum 12 by the pushing forces of both the compression springs 51 (that is, the resultant force of the pushing force of the compression spring 51 that is provided at the outer position in the horizontal direction and the pushing force of the compression spring 51 that is provided at the inner position in the horizontal direction). Meanwhile, the pushing force of the color-side pushing unit 53B in this case is referred to as a first pushing force. Furthermore, like the color-side pushing unit 53B, the black-side pushing unit 53A also pushes the transfer roller 19 toward the photosensitive drum 12 by the first pushing force.

Moreover, the eccentric cam 52 is rotated clockwise in right side view by driving means (not shown) provided in the main body casing 2. Accordingly, the eccentric cam 52 comes into contact with the rear end portion of the pressing member 54 from above, and presses down the rear end portion of the pressing member 54 against the pushing force of the compression spring 51 that is provided at the outer position in the horizontal direction.

As a result, the pressing member 54 is rotated clockwise in right side view against the pushing force of the compression spring 51, which is provided at the outer position in the horizontal direction, and is separated from the transfer roller shaft 34 toward the lower side.

Figure 3B:
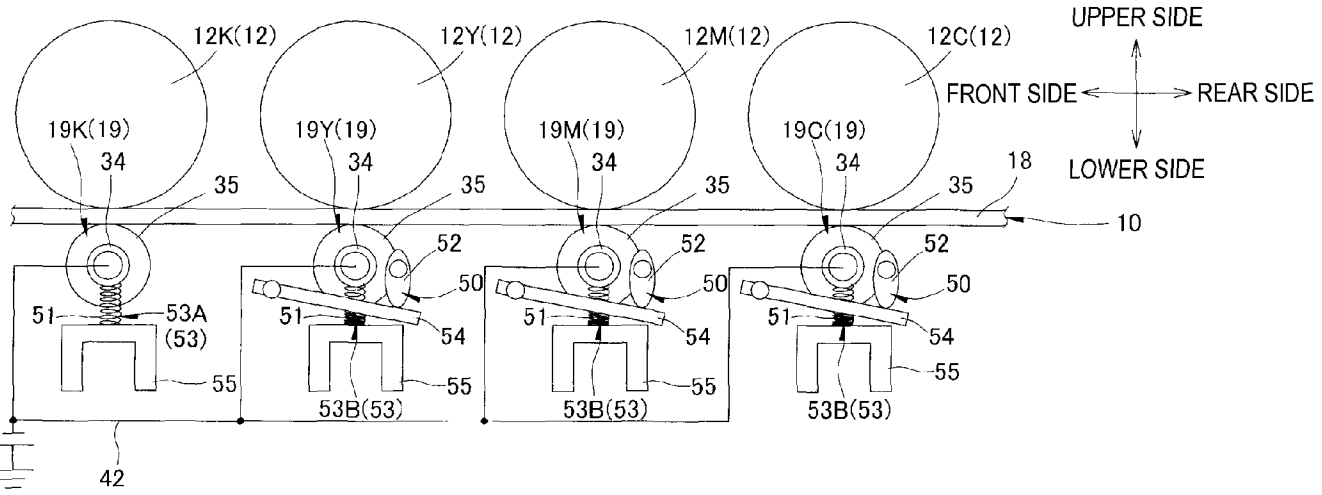
Figure 4A:
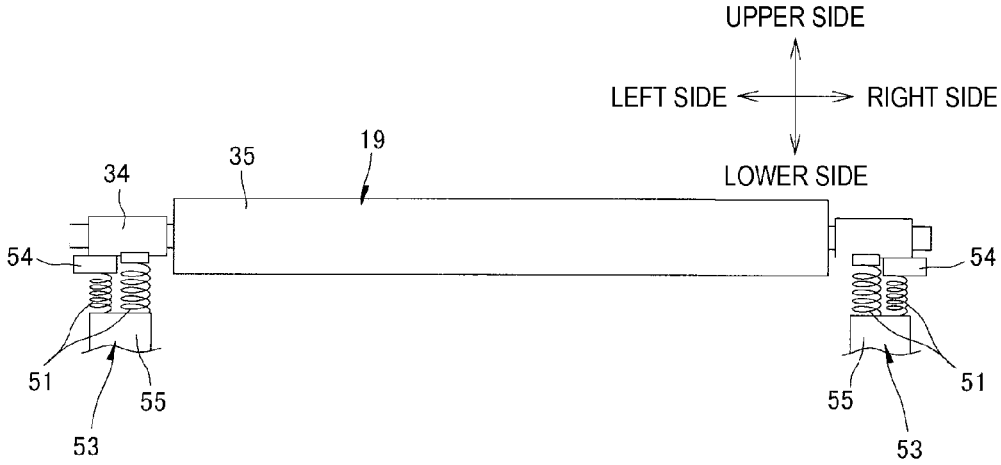
FIG. 4A and FIG. 4B are front views illustrating the operation of the transfer unit of the second embodiment, where
Figure 4B:
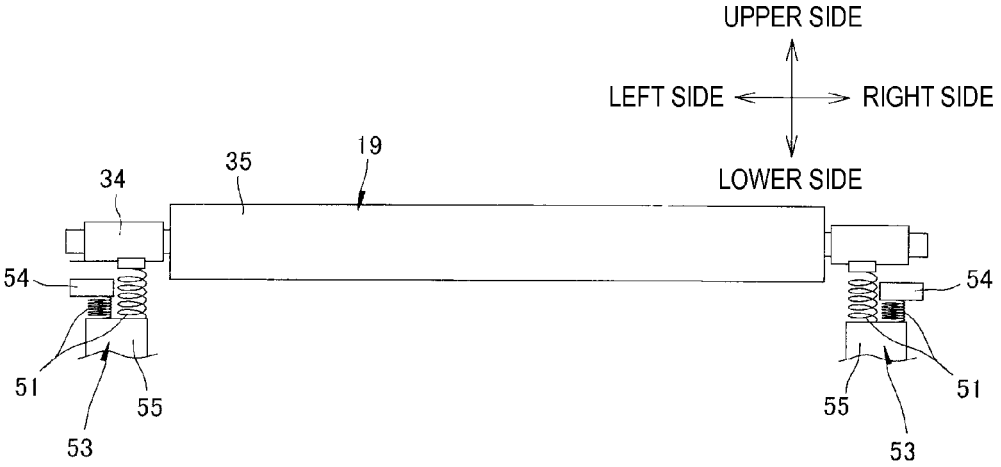

Accordingly, the push of the compression springs 51, which are provided at the outer positions in the horizontal direction, to the transfer roller shaft 34 is released as shown in FIGS. 3B and 4B, and the color-side pushing unit 53B pushes the transfer roller 19 toward the photosensitive drum 12 by only the pushing forces of the compression springs 51 that are provided at the inner positions in the horizontal direction. That is, the color-side pushing unit 53B pushes the corresponding transfer roller 19 toward the photosensitive drum 12 by the second pushing force smaller than the first pushing force.

Even in the color laser printer 1 according to the second embodiment, it may be possible to obtain the same operational advantages as the operational advantages of the above-mentioned first embodiment.

6. [Third Embodiment]

In the above-mentioned respective embodiments, the pushing force of the black-side compression spring 31A or the black-side pushing unit 53A has not been changed in the color mode and the monochrome mode. In a third embodiment, the pushing force of a black-side compression spring 31A or a black-side pushing unit 53A in a monochrome mode is changed to be smaller than the pushing force thereof in a color mode. Meanwhile, in the third embodiment, the same members as those of the above-mentioned respective embodiments are denoted by the same reference numerals and the description thereof will be omitted.

For example, the translation cam mechanism 30 or the eccentric cam mechanisms 50 are provided so as to correspond to all the transfer rollers 19, and the pushing forces of all the compression springs 31 or the pushing units 53 in a monochrome mode are changed so as to be smaller than the pushing forces thereof in a color mode.

According to the color laser printer 1 of the third embodiment, not only the pressing forces of the respective color transfer rollers 19 applied to the color photosensitive drums 12 but also the pressing force of the black transfer roller 19K applied to the black photosensitive drum 12K is reduced in the monochrome mode.

For this reason, it may be possible to suppress the excessive transfer of toner to the sheet P from the black photosensitive drum 12K that is caused by the pressing force of the black transfer roller 19K.

Accordingly, when the sheet P to which a black toner image has been transferred faces the color photosensitive drums 12, it may be possible to further suppress the transfer of the toner image of the sheet P to the respective color photosensitive drums 12.

As a result, it may be possible to further suppress the generation of a reverse transfer ghost in the monochrome mode.

Further, even in the color laser printer 1 according to the third embodiment, it may be possible to obtain the same operational advantages as the operational advantages of the above-mentioned respective embodiments.

7. [Another Embodiment]

The pushing forces of all the color-side compression springs 31B or the color-side pushing units 53B have been changed in the above-mentioned respective embodiments, but only the pushing forces of the compression springs 31 applied to the yellow transfer roller 19Y or only the pushing force of the pushing unit 53 applied to the yellow transfer roller may be changed.

A reverse transfer ghost in the monochrome mode is mainly apt to be generated on the yellow photosensitive drum 12Y that is disposed on the rear side of the black photosensitive drum 12K and is immediately adjacent to the black photosensitive drum 12K, and the frequency of the generation of a reverse transfer ghost is low on the magenta photosensitive drum 12M or the cyan photosensitive drum 12C that is disposed on the rear side of the yellow photosensitive drum 12Y.

For this reason, it may be possible to suppress the generation of a reverse transfer ghost in the monochrome mode by suppressing the generation of a reverse transfer ghost on the yellow photosensitive drum 12Y through the reduction of the pressing force of the yellow transfer roller 19Y to the yellow photosensitive drum 12Y.

[Fourth Embodiment]

1. Entire Structure of Color Laser Printer

Figure 5:
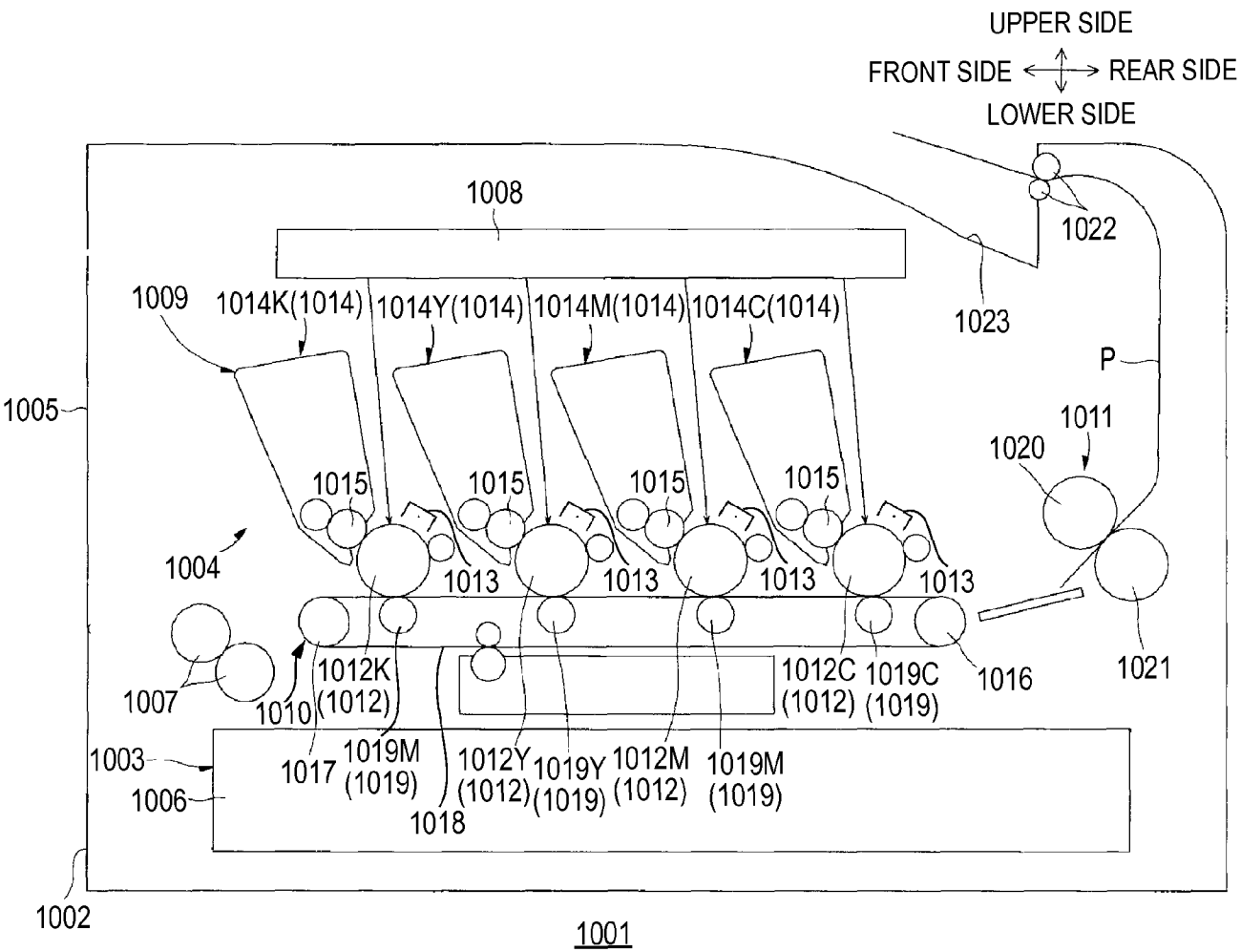
FIG. 5 is a side cross-sectional view of a color laser printer as an example of an image forming apparatus according to the invention.

As shown in FIG. 5, a color laser printer 1001 as an example of an image forming apparatus is a horizontally-mounted direct tandem-type color laser printer. The color laser printer 1001 includes a sheet feed section 1003 and an image forming section 1004 that are disposed in a main body casing 1002. The sheet feed section 1003 feeds a sheet P as an example of a transfer receiving member. The image forming section 1004 forms an image on the fed sheet P.

(1) Main Body Casing

The main body casing 1002 is formed in the shape of a substantially rectangular box in side view so as to accommodate the sheet feed section 1003 and the image forming section 1004. A front cover 1005, which is used for the attachment or detachment of a process unit 1009 to be described below, is formed at one side wall of the main body casing 1002. The front cover 1005 is provided so as to be pivotable about a lower end portion of the front cover relative to the main body casing 1002.

Meanwhile, in the following description, the side (the left side in FIG. 5) where the front cover 1005 is provided is referred to as the front side and the side opposite (the right side in FIG. 5) is referred to as the rear side. Further, when the color laser printer 1001 is seen from the front side, the left and right sides of the color laser printer become references. That is, the front side in FIG. 5 is the right side and the back side in FIG. 5 is the left side.

(2) Sheet Feed Section

The sheet feed section 1003 includes a sheet feed tray 1006 that stores sheets P. The sheet feed tray 1006 is detachably mounted on a bottom in the main body casing 1002.

The sheets P stored in the sheet feed tray 1006 are fed toward a gap between a pair of resist rollers 1007, which is disposed above a front end portion of the sheet feed tray 1006, one by one, and are conveyed toward the image forming section 1004 (a gap between a photosensitive drum 1012 (to be described below) and a conveying belt 1018 (to be described below)) at a predetermined timing.

(3) Image Forming Section

The image forming section 1004 includes a scanner unit 1008, process units 1009, a transfer unit 1010, and a fixing unit 1011.

(3-1) Scanner Unit

The scanner unit 1008 is disposed at an upper portion of the main body casing 1002. The scanner unit 1008 emits laser beams to four photosensitive drums 1012 (to be described below) on the basis of image data as shown by a solid line, and exposes the photosensitive drums 1012 (to be described below).

(3-2) Process Unit (3-2-1) Structure of Process Unit

Each of the process units 1009 is disposed below the scanner unit 1008 and on the transfer unit 1010, and includes a photosensitive drum 1012 as an example of a photosensitive body, a scorotron-type charger 1013, and a developing unit 1014.

Each of the photosensitive drums 1012 is formed substantially in the shape of a cylinder extending in a horizontal direction. Four photosensitive drums are horizontally disposed in parallel at intervals in a longitudinal direction. Specifically, a black photosensitive drum 1012K as an example of a first photosensitive body, and a yellow photosensitive drum 1012Y, a magenta photosensitive drum 1012M, and a cyan photosensitive drum 1012C as examples of three second photosensitive bodies are sequentially disposed from the front side toward the rear side.

The scorotron-type charger 1013 is disposed on the upper rear side of each photosensitive drum 1012 with an interval between the scorotron-type charger and each photosensitive drum so as to face each photosensitive drum 1012.

The developing units 1014 are disposed above the photosensitive drums 1012 so as to correspond to the respective photosensitive drums 1012. Specifically, a black developing unit 1014K, a yellow developing unit 1014Y, a magenta developing unit 1014M, and a cyan developing unit 1014C are sequentially disposed from the front side toward the rear side.

Further, each of the developing units 1014 includes a developing roller 1015.

The developing roller 1015 is rotatably supported at a lower end of the developing unit 1014 so as to be exposed from the rear side, faces the photosensitive drum 1012 from the upper front side, and comes onto contact with the photosensitive drum 1012.

Toner as an example of a developer corresponding to each of the colors is stored in a space above the developing roller 1015 in each developing unit 1014.

(3-2-2) Developing Operation in Process Unit

As the developing roller 1015 is rotated, the toner stored in the developing unit 1014 is carried onto the surface of the developing roller 1015.

Meanwhile, as the photosensitive drum 1012 is rotated, the surface of the photosensitive drum 1012 is uniformly charged by the scorotron-type charger 1013 and then exposed by the high-speed scanning of the laser beam (see broken lines in FIG. 5) emitted from the scanner unit 1008. Accordingly, an electrostatic latent image, which corresponds to an image to be formed on a sheet P, is formed on the surface of the photosensitive drum 1012.

When the photosensitive drum 1012 is further rotated, the toner carried onto the surface of the developing roller 1015 is supplied to the electrostatic latent image that is formed on the surface of the photosensitive drum 1012. Accordingly, the electrostatic latent image formed on the photosensitive drum 1012 is changed into a visible image, and a toner image formed by reversal development is carried on the surface of the photosensitive drum 1012.

(3-3) Transfer Unit

The transfer unit 1010 is disposed along the longitudinal direction above the sheet feed section 1003 and below the process unit 1009 in the main body casing 1002. The transfer unit 1010 includes a driving roller 1016, a driven roller 1017, a conveying belt 1018, and four transfer rollers 1019.

The driving roller 1016 and the driven roller 1017 are disposed so as to face each other with an interval therebetween in the longitudinal direction.

The conveying belt 1018 faces the respective photosensitive drums 1012 from below, and is wound around the driving roller 1016 and the driven roller 1017 so that the upper portion of the conveying belt comes into contact with the respective photosensitive drums 1012. Further, the conveying belt 1018 is rolled along by the driving of the driving roller 1016 so that the upper portion of the conveying belt 1018 coming into contact with the respective photosensitive drums 1012 is moved from the front side toward the rear side.

The respective transfer rollers 1019 are provided so as to face the respective photosensitive drums 1012 while the upper portion of the conveying belt 1018 is interposed between the transfer rollers and the photosensitive drums. Specifically, a black transfer roller 1019K as an example of a first transfer member facing the black photosensitive drum 1012K; and a yellow transfer roller 1019Y, a magenta transfer roller 1019M, and a cyan transfer roller 1019C as examples of three second transfer members, which face the yellow photosensitive drum 1012Y, the magenta photosensitive drum 1012M, and the cyan photosensitive drum 1012C, respectively, are sequentially disposed from the front side toward the rear side.

Further, a sheet P fed from the sheet feed section 1003 is conveyed from the front side toward the rear side by the conveying belt 1018 so as to sequentially pass through transfer positions where the respective photosensitive drums 1012 face the respective transfer rollers 1019. While the sheet is conveyed, the respective color toner images carried on the respective photosensitive drums 1012 are sequentially transferred to the sheet P, so that a color image is formed.

(3-4) Fixing Unit

The fixing unit 1011 is disposed on the rear side of the transfer unit 1010, and includes a heating roller 1020 and a pressure roller 1021 facing the heating roller 1020. In the transfer unit 1010, a color image transferred to the sheet P is thermally fixed to the sheet P by being heated and pressed while the sheet P passes between the heating roller 1020 and the pressure roller 1021.

(4) Sheet Discharge

The sheet P to which the toner images have been fixed is conveyed by sheet discharge rollers 1022 so as to pass through a U-turn path (not shown), and is discharged onto a sheet discharge tray 1023 that is formed above the scanner unit 1008.

2. Detail of Transfer Unit (1) Structure of Transfer Unit

As described above and shown in FIG. 6, the transfer unit 1010 of the fourth embodiment includes the conveying belt 1018 that comes into contact with the respective photosensitive drums 1012 from below and the respective transfer rollers 1019 that face the respective photosensitive drums 1012 with the conveying belt 1018 interposed therebetween.

The conveying belt 1018 is made of an elastic material or the like having conductivity and is formed in an endless shape.

Each of the transfer rollers 1019 includes a transfer roller shaft 1034 and a roller portion 1035.

The transfer roller shaft 1034 is made of a conductive material such as metal and is formed in the shape of a rod extending in the horizontal direction.

The roller portion 1035 is made of an elastic material or the like having conductivity and is formed in a substantially cylindrical shape so as to cover the surface of the transfer roller shaft 1034.

Further, the transfer unit 1010 includes a translation cam mechanism 1030 as an example of a contact/separation member.

The translation cam mechanism 1030 includes support members 1032, compression springs 1031, and a translation cam 1033.

The support member 1032 is formed to have a substantially rectangular shape in side view, and is disposed at each of both the left and right ends of the transfer roller shaft 1034 of each of the transfer roller 1019, respectively. In detail, there are provided black-side support members 32A corresponding to a black transfer roller 1019K and color-side support members 1032B corresponding to the color transfer rollers 1019 (the yellow transfer roller 1019Y, the magenta transfer roller 1019M, and the cyan transfer roller 1019C), respectively. Further, a support member-side inclined surface 1029, which is inclined upward toward the front side, is formed at the rear upper end portion of each of the support members 1032. Furthermore, a transfer roller shaft insertion hole 1036 is formed at each of the support members 1032 so as to pass through each of the support members in the horizontal direction, and the transfer roller shaft 1034 is inserted through the transfer roller shaft insertion hole 1036 so as to be rotatable relative to the support member. Accordingly, the respective support members 1032 support the corresponding transfer roller shaft 1034.

Moreover, the color-side support members 1032B are supported by a frame 1028 of the transfer unit 1010 so as to be slidable in a vertical direction.

Accordingly, each of the color-side support members 1032B is slid up and thus moved to a contact position (see FIG. 6A) where each of the color transfer rollers 1019 comes into contact with the conveying belt 1018. Further, each of the color-side support members 1032B is slid down and thus moved to a separate position (see FIG. 6B) where each of the color transfer rollers 1019 is separated from the conveying belt 1018.

Meanwhile, the support members 1032 corresponding to the black transfer roller 1019K are fixed to the frame 1028 of the transfer unit 1010.

Each of the compression springs 1031 is provided between each of the support members 1032 and the frame 1028 of the transfer unit 1010.

One end of each of the compression springs 1031 is connected to a lower end portion of the corresponding support member 1032, and the other end thereof is connected to the frame 1028 of the transfer unit 1010.

Accordingly, the respective compression springs 1031 elastically press the transfer rollers 1019 toward the photosensitive drums 1012 through the support members 1032.

The translation cam 1033 is disposed between the conveying belt 1018 and the respective color-side support members 1032B, and is formed substantially in the shape of a bar extending in the longitudinal direction. Further, the translation cam 1033 includes three displacement portions 1037.

Each of the displacement portions 1037 protrudes downward from the lower surface of the translation cam 1033 and is formed to have a substantially trapezoidal shape in side view. The displacement portions 1037 are disposed in parallel at intervals in the longitudinal direction so as to correspond to the respective color-side support members 1032B. Furthermore, a cam-side inclined surface 1038, which is inclined upward toward the front side, is formed at the front end portion of each of the displacement portions 1037. The lower surface of each of the displacement portions 1037 is formed of a flat surface 1039 that continues from the rear end portion of the cam-side inclined surface 38 and extends toward the rear side.

Figure 6A:
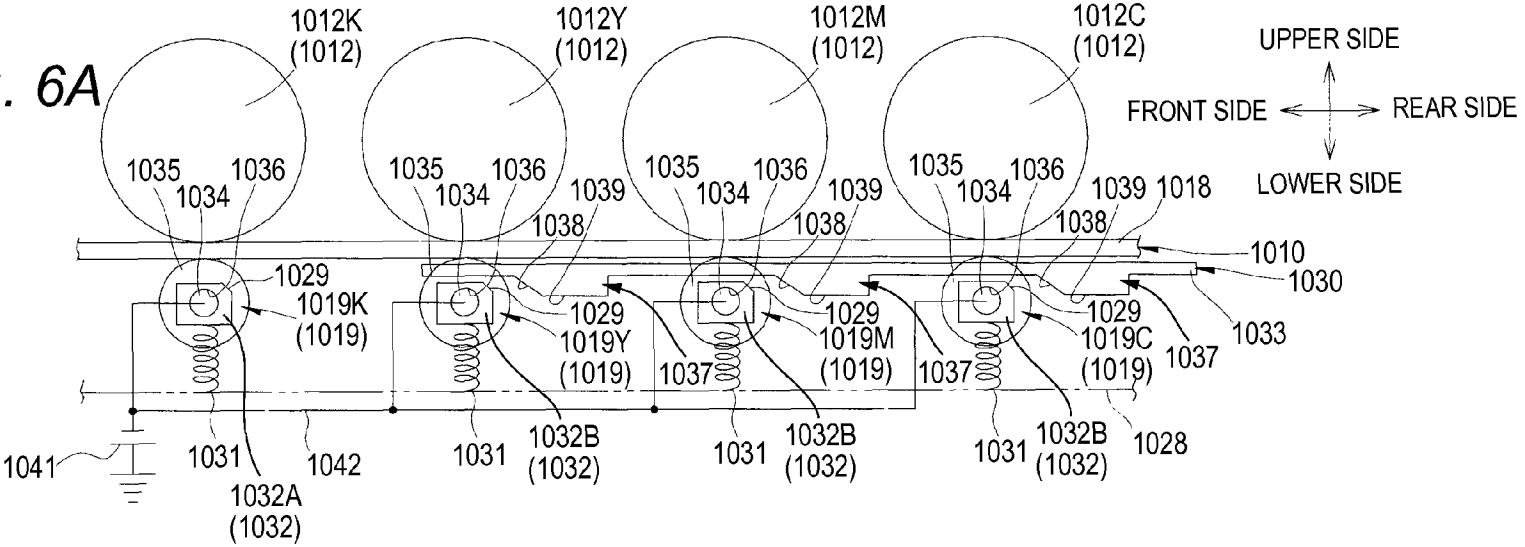

Moreover, the translation cam 1033 is supported by the frame 1028 of the transfer unit 1010 so as to be slidable in the longitudinal direction and make the respective displacement portions 1037 be disposed on the rear side of the corresponding color-side support members 1032B (see FIG. 6A).

In this case, the cam-side inclined surfaces 1038 of the respective displacement portions 1037 face the support member-side inclined surfaces 1029 of the corresponding color-side support members 1032B from the rear side.

(2) Contact/Separation Operation of Transfer Roller

When the respective displacement portions 1037 of the translation cam 1033 are disposed on the rear side of the corresponding color-side support members 1032B, the translation cam 1033 does not press the respective color-side support members 1032B as shown in FIG. 6A and the transfer rollers 1019 are disposed at the contact positions by the pushing forces of the compression springs 1031. Accordingly, the respective color transfer rollers 1019 come into contact with the conveying belt 1018.

Further, when the translation cam 1033 is slid forward by driving means (not shown) provided in the main body casing 1002, the cam-side inclined surfaces 1038 of the respective displacement portions 1037 come into contact with the support member-side inclined surfaces 1029 of the respective corresponding color-side support members 1032B.

Furthermore, when the translation cam 1033 is further moved forward, the support member-side inclined surfaces 1029 of the respective color-side support members 1032B are pressed down by the cam-side inclined surfaces 1038 of the corresponding displacement portions 1037 so as to be slid toward the lower rear side relative to the corresponding displacement portions 1037. Accordingly, each of the color-side support members 1032B is moved downward, so that each of the color transfer rollers 1019 is moved to the separate position from the contact position.

(3) Supply of Power to Transfer Unit

The main body casing 1002 is provided with a power source 1041 and transfer bias lines 1042 as an example of bias applying means.

The power source 1041 is provided in the main body casing 1002.

The transfer bias lines 1042 are electrically connected to the power source 1041 and the transfer roller shafts 1034 of the respective transfer rollers 1019.

Further, even though the color laser printer 1001 is in any one of the color mode (see FIG. 6A) and the monochrome mode (see FIG. 6B), transfer bias is applied to the respective transfer rollers 1019 through the respective transfer bias lines 1042.

3. Image Forming Operation (1) Image Forming Operation in Color Mode

When the color laser printer 1 is in the color mode, the translation cam 1033 is drawn back as described above and shown in FIG. 6A.

In this case, the respective color-side support members 1032B are slid up by the pushing forces of the compression springs 1031 and are disposed at the contact positions. Accordingly, the conveying belt 1018 comes into contact with the respective color transfer rollers 1019.

Then, as described above, a sheet P is conveyed from the front side toward the rear side by the conveying belt 1018 so as to sequentially pass through the transfer positions where the respective photosensitive drums 1012 face the respective transfer rollers 1019. While the sheet is conveyed, the respective color toner images carried on the respective photosensitive drums 1012 are sequentially transferred to the sheet P by transfer bias, so that a color image is formed.

(2) Image Forming Operation in Monochrome Mode

When the mode of the color laser printer 1001 is switched to the monochrome mode from the color mode, the translation cam 1033 is slid forward by the driving means (not shown) provided in the main body casing 1002.

As a result, each of the color-side support members 1032B is pressed down by the translation cam 1033 as described above. Accordingly, the respective color transfer rollers 1019 are separated from conveying belt 1018.

Then, as described above, a sheet P is conveyed from the front side toward the rear side by the conveying belt 1018 so as to sequentially pass through the transfer positions where the respective photosensitive drums 1012 face the respective transfer rollers 1019.

Accordingly, first, when the sheet P faces the black photosensitive drum 1012K, a black toner image carried on the black photosensitive drum 1012K is transferred to the sheet P.

After that, the sheet P sequentially passes between the respective corresponding transfer rollers 1019 and the respective color photosensitive drums 1012 on which toner images are not carried.

In this case, the respective color transfer rollers 1019 are separated from the conveying belt 1018 as described above. That is, the black toner image transferred to the sheet P is not pressed against the respective color photosensitive drums 1012 by the respective color transfer rollers 1019. Further, transfer bias is applied to the respective color transfer rollers 1019.

For this reason, the black toner image transferred to the sheet P is carried on the surface of the sheet P by transfer bias without being attached to the surfaces of the respective color photosensitive drums 1012.

That is, the reverse transfer of the black toner image, which has been transferred to the sheet P, to the respective color photosensitive drums 1012 is suppressed.

Accordingly, in the monochrome mode, a monochrome image is formed on the sheet P without the generation of a reverse transfer ghost.

Meanwhile, when the mode of the color laser printer is switched to the color mode, the translation cam 1033 is slid rearward again by the driving means (not shown) provided in the main body casing 1002.

Figure 6B:
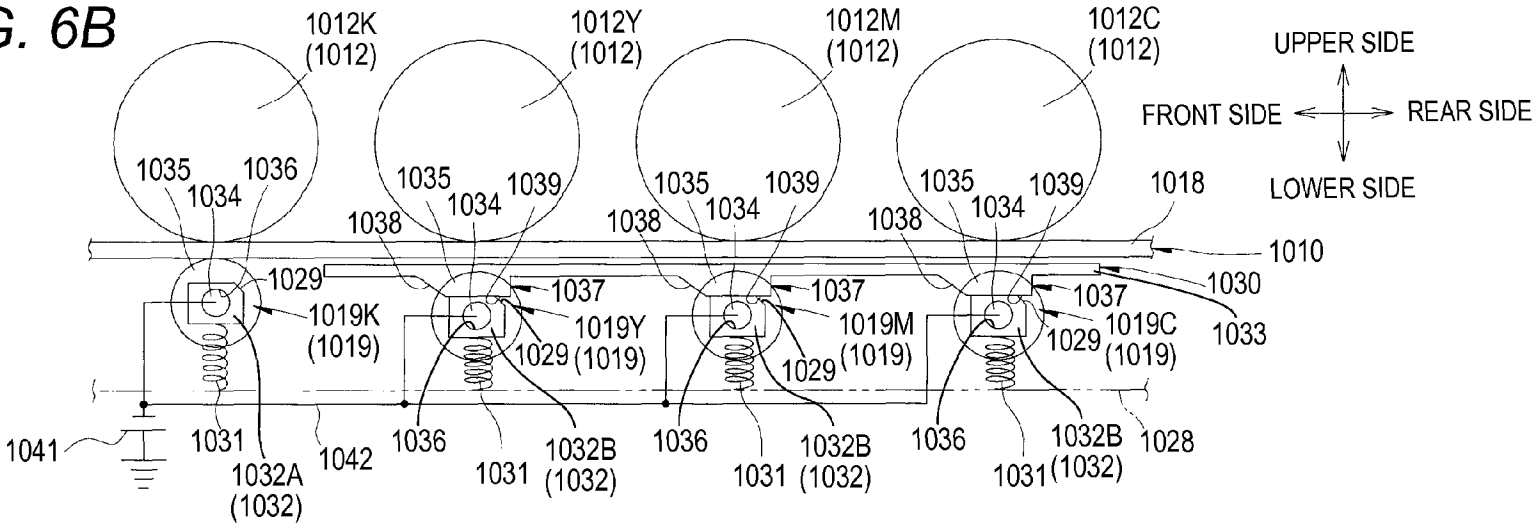

4. Operational Advantages (1) According to the color laser printer 1001, as shown in FIG. 6B, the respective color transfer rollers 1019 are separated from the conveying belt 1018 in the monochrome mode while transfer bias is applied to the respective color transfer rollers.

For this reason, it may be possible to reduce a pressing force of the sheet P that is applied to the respective color photosensitive drums 1012, and to continue to carry the toner image, which has been transferred to the sheet P, on the sheet P by the transfer bias applied to the respective color transfer rollers 1019.

Accordingly, it may be possible to suppress the reverse transfer of the toner image, which has been transferred to the sheet P, to the respective color photosensitive drums 1012.

As a result, in the direct tandem-type color laser printer 1001, it may be possible to suppress the generation of a reverse transfer ghost in the monochrome mode.

(2) Further, according to the color laser printer 1001, the black photosensitive drum 1012K is disposed on the front side of all the color photosensitive drums 1012 as shown in FIG. 6.

For this reason, in the color mode, it may be possible to form various colors by sequentially superimposing color toner images on the black toner image (for example, it may be possible to form brown by superimposing yellow on a black base).

As a result, it may be possible to form various colors in the color mode.

(3) Furthermore, according to the color laser printer 1001, as shown in FIG. 6, the translation cam mechanism 1030 separates all the respective color transfer rollers 1019 from the photosensitive drums 1012.

For this reason, it may be possible to more reliably suppress the generation of a reverse transfer ghost in the monochrome mode.

5. [Fifth Embodiment]

In the above-mentioned fourth embodiment, the respective color transfer rollers 1019 are separated from the photosensitive drums 1012 in the monochrome mode while transfer bias is applied to the respective color transfer rollers.

Figure 7A:
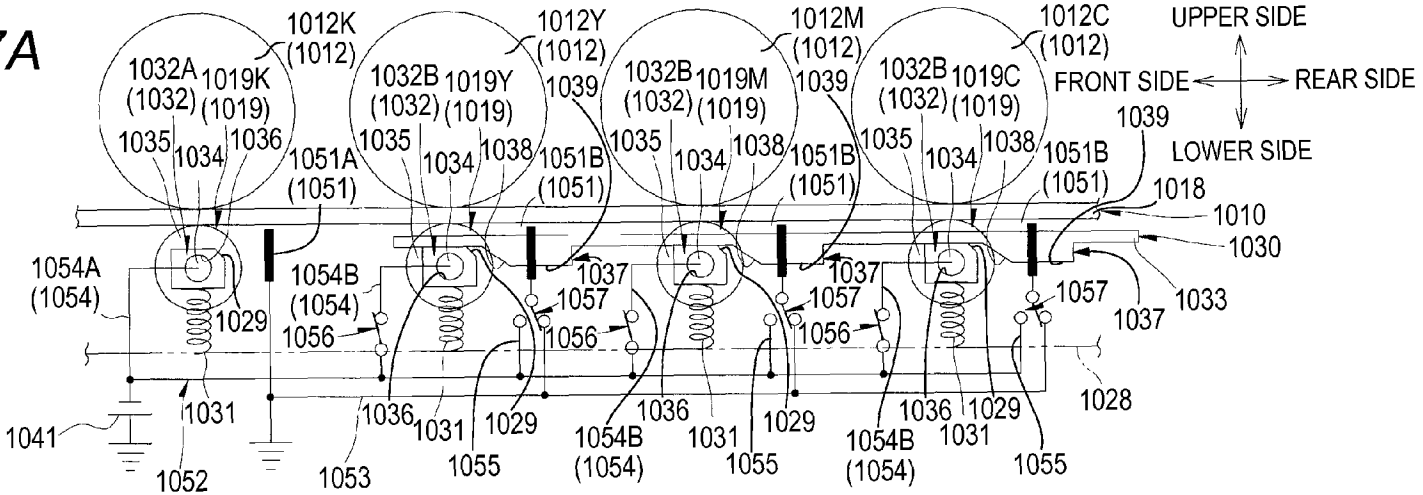
Figure 7B:
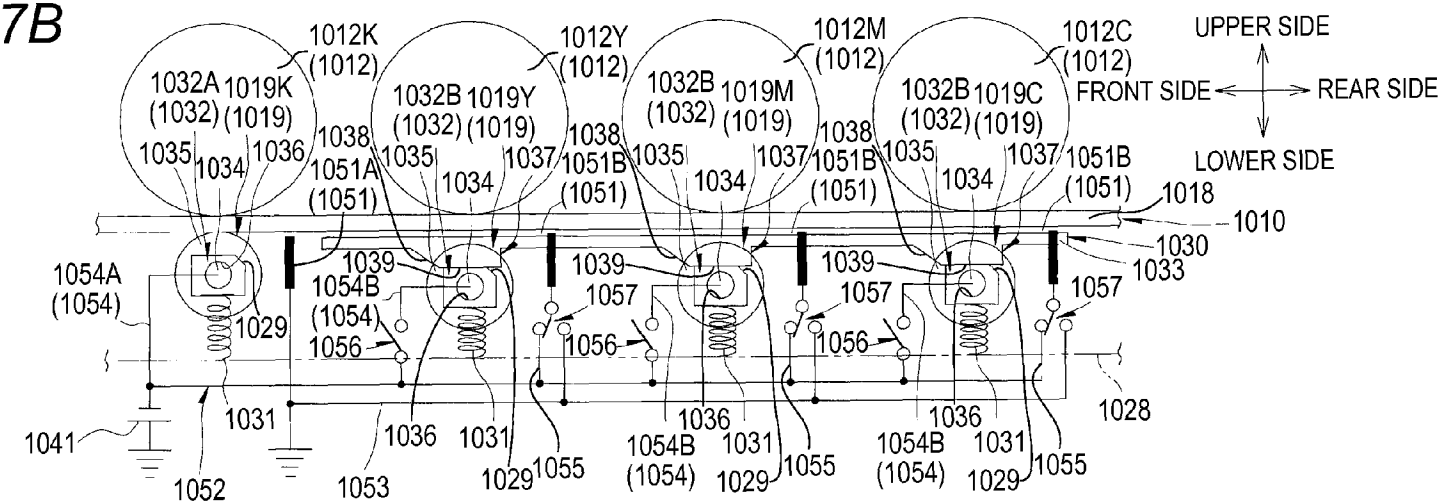

On the other hand, in the fifth embodiment, transfer bias is applied to color-side charge removing members 1051B and the respective color transfer rollers 1019 are separated from the photosensitive drums 1012 in the monochrome mode as shown in FIG. 7B while transfer bias is applied to the respective color transfer rollers. Meanwhile, in the fifth embodiment, the same members as those of the above-mentioned fourth embodiment are denoted by the same reference numerals and the description thereof will be omitted.

(1) Structure of Transfer Unit

A transfer unit 1010 includes charge removing members 1051.

Each of the charge removing members 1051 is made of a conductive material such as metal, is formed in the shape of a substantially flat plate extending in a horizontal direction, and is disposed on the rear side of each transfer roller 1019 so as to be adjacent to each transfer roller. Specifically, a black-side charge removing member 1051A that is disposed adjacent to the black transfer roller 1019K and color-side charge removing members 1051B that are disposed adjacent to the color transfer rollers 1019, respectively, are sequentially arranged. Further, the charge removing members 1051 are disposed so as to face the conveying belt 1018 with a small interval between the conveying belt and the charge removing members.

(2) Supply of Power to Transfer Unit

A main body casing 1002 is provided with a bias line 1052 that is electrically connected to the respective transfer rollers 1019 and the respective color-side charge removing members 1051B, ground lines 1053 that ground all the charge removing members 1051, and first switches 1057.

The bias line 1052 is connected to a power source 1041, and includes transfer roller-side bias lines 1054 as an example of first bias applying means and charge removing member-side bias lines 1055 as an example of second bias applying means.

Four transfer roller-side bias lines 1054 are provided so as to correspond to the respective transfer rollers 1019, and are electrically connected to the respective transfer rollers 1019. Specifically, there are provided a black transfer roller-side bias line 1054A that is connected to the black transfer roller 1019K and color transfer roller-side bias lines 1054B that are connected to the color transfer rollers 1019, respectively.

Further, a second switch 1056 is provided on each of the color transfer roller-side bias lines 1054B.

The second switch 1056 makes an electric current flow in the color transfer roller-side bias line 1054B so that the mode of the second switch is switched to an ON-state (see FIG. 7A) where power is supplied to the transfer roller 1019 from the power source 1041. The second switch 1056 breaks an electric current flowing in the color transfer roller-side bias line 1054B so that the mode of the second switch is switched to an OFF-state (see FIG. 7B) where power is not supplied to the transfer roller 19 from the power source 1041.

Three charge removing member-side bias lines 1055 are provided so as to correspond to the respective color-side charge removing members 1051B, and are electrically connected to the color-side charge removing members 1051B through the first switches 1057, respectively.

The ground lines 1053 are grounded, and four ground lines are provided so as to correspond to the respective charge removing members 1051. Specifically, there are provided a black-side ground line 1053A that is connected to the black-side charge removing member 1051A, and color-side ground lines 1053B that are connected to the color-side charge removing members 1051B through the first switches 1057, respectively.

Three first switches 1057 are provided so as to correspond to the respective color-side charge removing members 1051B. The first switches 1057 are connected to the color-side charge removing members 1051B, respectively, and are selectively connected to the color transfer roller-side bias lines 1054B and the color-side ground lines 1053B.

That is, each of the first switches 1057 is switched to a ground side (see FIG. 7A) where the color-side charge removing member 1051B and the color-side ground line 1053B are connected to each other and the connection between the color-side charge removing member 1051B and the color transfer roller-side bias line 1054B is released, and a bias side (see FIG. 7B) where the color-side charge removing member 1051B and the color transfer roller-side bias line 1054B are connected to each other and the connection between the color-side charge removing member 1051B and the color-side ground line 1053B is released.

Further, when the color laser printer 1001 is in the color mode, the first switches 1057 are switched to the ground side and the second switches 1056 are turned on as shown in FIG. 7A.

Accordingly, the color-side charge removing members 1051B are grounded through the color-side ground lines 1053B, and transfer bias is applied to the respective color transfer rollers 1019 through the color transfer roller-side bias lines 1054B.

Meanwhile, the black-side charge removing member 1051A is also grounded through the black-side ground line 1053A, and transfer bias is also applied to the black transfer roller 1019K through the black transfer roller-side bias line 1054A.

That is, when the color laser printer 1001 is in the color mode, all the charge removing members 1051 are grounded and transfer bias is applied to all the transfer rollers 1019.

Further, when the mode of the color laser printer 1001 is switched to the monochrome mode from the color mode, the first switches 1057 are switched to the bias side and the second switches 1056 are turned off as shown in FIG. 7B.

Accordingly, transfer bias is applied to the color-side charge removing members 1051B through the charge removing member-side bias lines 1055 and transfer bias is not applied to the respective color transfer rollers 1019.

Meanwhile, the black-side charge removing member 1051A is grounded through the black-side ground line 1053A and transfer bias is applied to the black transfer roller 1019K through the black transfer roller-side bias line 1054A.

That is, when the color laser printer 1001 is in the monochrome mode, the application of transfer bias to the respective color transfer rollers 1019 among the respective transfer rollers 1019 is released and transfer bias is applied to the color-side charge removing members 1051B among the respective charge removing members 1051.

(3) Operational Advantages of Fifth Embodiment

According to the color laser printer 1001 of the fifth embodiment, as shown in FIG. 7B, in the monochrome mode, transfer bias is not applied to the respective color transfer rollers, the respective color transfer rollers 1019 are separated from the conveying belt 1018, and transfer bias is applied to the respective color-side charge removing members 1051B that are disposed adjacent to the respective color transfer rollers 1019 on the rear side of the respective color transfer rollers 1019.

For this reason, it may be possible to reduce a pressing force of the sheet P that is applied to the respective color photosensitive drums 1012, and to continue to carry the toner image, which has been transferred to the sheet P, on the sheet P by the transfer bias applied to the color-side charge removing members 1051B.

Accordingly, it may be possible to suppress the reverse transfer of the toner image, which has been transferred to the sheet P, to the respective color photosensitive drums 1012.

As a result, in the direct tandem-type color laser printer 1001, it may be possible to suppress the generation of a reverse transfer ghost in the monochrome mode.

Further, according to the color laser printer 1001 of the fifth embodiment, it may be possible to obtain the same operational advantages as the operational advantages of the above-mentioned color laser printer 1001 of the fourth embodiment.

6. Another Embodiment

Moreover, in the above-mentioned respective embodiments, all the respective color transfer rollers 1019 have been separated from the corresponding photosensitive drums 1012. However, only the yellow transfer roller 1019Y may be separated from the yellow photosensitive drum 1012Y.

A reverse transfer ghost in the monochrome mode is mainly apt to be generated on the yellow photosensitive drum 1012Y that is disposed adjacent to the black photosensitive drum 1012K on the rear side of the black photosensitive drum 1012K, and the frequency of the generation of a reverse transfer ghost is low on the magenta photosensitive drum 1012M or the cyan photosensitive drum 1012C that is disposed on the rear side of the yellow photosensitive drum 1012Y and is immediately adjacent to the yellow photosensitive drum 1012Y.

For this reason, it may be possible to suppress the generation of a reverse transfer ghost in the monochrome mode by suppressing the generation of a reverse transfer ghost on the yellow photosensitive drum 1012Y through the separation of the yellow transfer roller 1019Y from the yellow photosensitive drum 1012Y.

What is claimed is:

1. An image forming apparatus of which a mode is switched to a monochrome mode where a monochrome image is formed and a color mode where a color image is formed, the image forming apparatus comprising:

a conveying belt that conveys a transfer receiving member;

a first photosensitive member that carries a black developer image to be the transfer receiving member;

a second photosensitive member that carries a developer image except for the black developer image to be the transfer receiving member, the second photosensitive member disposed on the downstream side of the first photosensitive member in a conveying direction of the transfer receiving member, a first transfer member that faces the first photosensitive member with the conveying belt interposed therebetween;

a second transfer member that faces the second photosensitive member with the conveying belt interposed therebetween;

a first pushing member that is configured to push the first transfer member toward the first photosensitive member;

a second pushing member that is configured to push the second transfer member toward the second photosensitive member; and a changing unit that changes the pushing force of the second pushing member to a first pushing force set in the color mode and a second pushing force set to be smaller than the first pushing force in the monochrome mode.

2. The image forming apparatus according to claim 1, further comprising, a third photosensitive member that carries a developer image except for the black developer image to be the transfer receiving member, the third photosensitive member disposed on the downstream side of the second photosensitive member in a conveying direction of the transfer receiving member.

3. The image forming apparatus according to claim 2 further comprising, a third pushing member that is configured to push the third transfer member toward the third photosensitive member; and wherein the changing unit changes the pushing force of the third pushing member to the first pushing force and the second pushing force.

4. The image forming apparatus according to claim 1, wherein the pushing force of the first pushing member in the monochrome mode is set to be smaller than the pushing force of the first pushing member in the color mode.

5. The image forming apparatus according to claim 1, wherein a transfer bias is applied to the first transfer member and the second transfer member in the monochrome mode and the color mode.

6. The image forming apparatus according to claim 3, wherein a transfer bias is applied to the first transfer member, the second transfer member and the third transfer member in the monochrome mode and the color mode.

7. An image forming apparatus of which a mode is switched to a monochrome mode where a monochrome image is formed and a color mode where a color image is formed, the image forming apparatus comprising:

a conveying belt that conveys a transfer receiving member;

a first photosensitive member that carries a black developer image to be the transfer receiving member;

a second photosensitive member that carries a developer image except for the black developer image to be the transfer receiving member, the second photosensitive member disposed on the downstream side of the first photosensitive member in a conveying direction of the transfer receiving member;

a first transfer member that faces the first photosensitive member with the conveying belt interposed therebetween;

a second transfer member that faces the second photosensitive member with the conveying belt interposed therebetween;

a moving member that moves the second transfer member between a contact position where the second transfer member contacts with the conveying belt in the color mode and a separate position where the second transfer member is separated from the conveying belt in the monochrome mode; and a bias applying unit that applies bias to the first transfer member and the second transfer member in both the monochrome mode and the color mode.

8. The image forming apparatus according to claim 7, further comprising:

a third photosensitive member that carries a developer image except for the black developer image to be the transfer receiving member, the third photosensitive member disposed on the downstream side of the second photosensitive member in a conveying direction of the transfer receiving member; and a third transfer member that faces the third photosensitive member with the conveying belt interposed therebetween.

9. The image forming apparatus according to claim 8, wherein the moving member moves the third transfer member between a contact position where the third transfer member contacts with the conveying belt in the color mode and a separate position where the third transfer member is separated from the conveying belt in the monochrome mode; and the bias applying unit further applies bias to the third transfer member in both the monochrome mode and the color mode.

10. An image forming apparatus of which a mode is switched to a monochrome mode where a monochrome image is formed and a color mode where a color image is formed, the image forming apparatus comprising:

a conveying belt that conveys a transfer receiving member;

a first photosensitive member that carries a black developer image to be the transfer receiving member;

a second photosensitive member that carries a developer image except for the black developer image to be the transfer receiving member, the second photosensitive member disposed on the downstream side of the first photosensitive member in a conveying direction of the transfer receiving member, a first transfer member that faces the first photosensitive member with the conveying belt interposed therebetween;

a second transfer member that faces the second photosensitive member with the conveying belt interposed therebetween;

a charge removing member that is disposed adjacent to the second transfer member on the downstream side of the second transfer member in a conveying direction of the transfer receiving member, and faces the conveying belt;

a moving member that moves the second transfer member between a contact position where the second transfer member contacts with the conveying belt in the color mode and a separate position where the second transfer member is separated from the conveying belt in the monochrome mode; and a first bias applying unit that applies a transfer bias to the first transfer member and the second transfer member when the second transfer member is located on the contact position in the color mode, wherein the first bias applying unit applies the transfer bias to the first transfer member and does not apply the transfer bias to the second transfer member when the second transfer member is located on the separate position in the monochrome mode; and a second bias applying unit that applies a transfer bias to the charge removing member when the second transfer member is located on the separate position in the monochrome mode.

11. The image forming apparatus according to claim 10, further comprising: a third photosensitive member that carries a developer image except for the black developer image to be the transfer receiving member, the third photosensitive member disposed on the downstream side of the second photosensitive member in a conveying direction of the transfer receiving member; and a third transfer member that faces the third photosensitive member with the conveying belt interposed therebetween.

12. The image forming apparatus according to claim 11, wherein the moving member moves the third transfer member between a contact position where the third transfer member contacts with the conveying belt in the color mode and a separate position where the third transfer member is separated from the conveying belt in the monochrome mode; and the first bias applying unit further applies bias to the third transfer member in both the monochrome mode and the color mode.

* * * * *